US012279640B2

(12) United States Patent
Capelli et al.

(10) Patent No.: US 12,279,640 B2
(45) Date of Patent: Apr. 22, 2025

(54) AEROSOL-GENERATING FILM

(71) Applicant: Philip Morris Products S.A., Neuchatel (CH)

(72) Inventors: Sebastien Capelli, Neuchatel (CH); Jean-Yves Vollmer, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 653 days.

(21) Appl. No.: 17/602,090

(22) PCT Filed: Mar. 18, 2020

(86) PCT No.: PCT/EP2020/057520
§ 371 (c)(1),
(2) Date: Oct. 7, 2021

(87) PCT Pub. No.: WO2020/207735
PCT Pub. Date: Oct. 15, 2020

(65) Prior Publication Data

US 2022/0202063 A1 Jun. 30, 2022

(30) Foreign Application Priority Data

Apr. 8, 2019 (EP) ..... 19167969

(51) Int. Cl.

| | |
|---|---|
| ***A24B 15/18*** | (2006.01) |
| ***A24B 15/14*** | (2006.01) |
| ***A24B 15/167*** | (2020.01) |
| ***A24B 15/28*** | (2006.01) |
| ***A24B 15/30*** | (2006.01) |
| ***A24B 15/32*** | (2006.01) |
| ***A24D 1/18*** | (2006.01) |

(52) U.S. Cl.
CPC ..... *A24B 15/186* (2013.01); *A24B 15/14* (2013.01); *A24B 15/167* (2016.11); *A24B 15/283* (2013.01); *A24B 15/303* (2013.01); *A24B 15/32* (2013.01); *A24D 1/18* (2013.01)

(58) Field of Classification Search
CPC ..... A24B 15/14; A24B 15/32; A24B 15/167; A24B 15/186; A24B 15/283; A24B 15/303; A24D 1/18
See application file for complete search history.

(56) References Cited

U.S. PATENT DOCUMENTS

| | | | | |
|---|---|---|---|---|
| 4,008,723 | A | 2/1977 | Borthwick et al. | |
| 4,014,349 | A * | 3/1977 | Morman | A24B 15/165 131/369 |
| 5,845,649 | A | 12/1998 | Saito et al. | |
| 7,938,125 | B2 | 5/2011 | John et al. | |
| 2004/0129280 | A1 | 7/2004 | Woodson et al. | |
| 2005/0244521 | A1 | 11/2005 | Strickland et al. | |
| 2007/0062550 | A1 | 3/2007 | John et al. | |
| 2009/0022856 | A1 | 1/2009 | Cheng et al. | |
| 2011/0088708 | A1 | 4/2011 | John et al. | |
| 2014/0166032 | A1 | 6/2014 | Gindrat | |
| 2018/0199617 | A1 | 7/2018 | Iodice | |
| 2019/0328030 | A1* | 10/2019 | Deforel | A24C 5/01 |
| 2020/0253264 | A1* | 8/2020 | Rousseau | A24D 1/20 |

FOREIGN PATENT DOCUMENTS

| | | | |
|---|---|---|---|
| AU | 2012207021 | A1 | 8/2012 |
| AU | 2014359187 | A1 | 3/2016 |
| CN | 106174694 | A | 12/2016 |
| EP | 2 713 778 | A2 | 4/2014 |
| EP | 3 104 718 | A1 | 12/2016 |
| EP | 3 351 121 | A1 | 7/2018 |
| GB | 815315 | A | 6/1959 |
| GB | 1 471 943 | A | 4/1977 |
| JP | 2017-538410 | A | 12/2017 |
| JP | 6371928 | B1 | 8/2018 |
| JP | 2019-95 | A | 1/2019 |
| RU | 2 436 882 | C2 | 12/2011 |
| RU | 2 602 969 | C2 | 11/2016 |
| WO | WO 2011/101164 | A1 | 8/2011 |
| WO | WO 2012/164009 | A2 | 12/2012 |
| WO | WO 2015/082652 | A1 | 6/2015 |
| WO | WO 2015/123422 | A1 | 8/2015 |
| WO | WO 2016/005530 | A1 | 1/2016 |
| WO | WO 2016/005531 | A1 | 1/2016 |
| WO | WO 2016/005533 | A1 | 1/2016 |
| WO | WO 2016/005600 | A1 | 1/2016 |

(Continued)

OTHER PUBLICATIONS

International Search Report and Written Opinion issued on Jun. 17, 2020 in PCT/EP2020/057520 filed Mar. 18, 2020, 10 pages.
Combined Russian Office Action and Search Report issued Jul. 7, 2023 in Russian Patent Application No. 2021128673/03 (with English Translation), 12 pages.
Combined Chinese Office Action and Search Report issued Sep. 1, 2022, in corresponding Chinese Patent Application No. 202080020127.3(with English Translation), 19 pages.
Extended European Search Report issued Oct. 10, 2019 in European Patent Application No. 19167969.5, 7 pages.
Office Action issued Mar. 25, 2024, in corresponding Japanese Patent Application No. 2021-554686 (with English Translation), 9 pages.

*Primary Examiner* — Christopher M Rodd
*Assistant Examiner* — Adam Z Baratz
(74) *Attorney, Agent, or Firm* — Oblon, McClelland, Maier & Neustadt, L.L.P.

(57) ABSTRACT

An aerosol-generating film having a tobacco content of less than 1 percent by weight is provided, the aerosol-generating film including: a cellulose based film-forming agent; a non-cellulose based thickening agent; water; nicotine; and a polyhydric alcohol, a content of cellulose based film-forming agent being at least about 14 wt percent weight and less than or equal to about 26 wt percent, and a content of water being less than about 30 wt percent and a content of polyhydric alcohol is at least about 30 wt percent.

16 Claims, No Drawings

(56) References Cited

FOREIGN PATENT DOCUMENTS

| | | | | | |
|---|---|---|---|---|---|
| WO | WO 2016/005601 | A1 | | 1/2016 | |
| WO | WO 2016/005602 | A1 | | 1/2016 | |
| WO | WO 2016/011623 | A1 | | 1/2016 | |
| WO | WO 2016/023965 | A1 | | 2/2016 | |
| WO | WO 2016/069876 | A1 | | 5/2016 | |
| WO | WO 2017/089931 | A1 | | 6/2017 | |
| WO | WO 2017/144861 | A1 | | 8/2017 | |
| WO | WO 2017/174595 | A1 | | 10/2017 | |
| WO | WO 2018/019543 | A1 | | 2/2018 | |
| WO | WO 2018/122095 | A1 | | 7/2018 | |
| WO | WO-2018122097 | A1 | * | 7/2018 | ..... A24B 15/12 |
| WO | WO 2019/129470 | A1 | | 7/2019 | |

* cited by examiner

AEROSOL-GENERATING FILM

The present invention relates to an aerosol-generating film. Aerosol-generating films in accordance with the present invention may find application as aerosol-generating substrates for producing an inhalable aerosol upon heating, and may therefore be used as components for aerosol-generating articles.

Aerosol-generating articles in which an aerosol-generating substrate, such as a nicotine-containing substrate or a tobacco-containing substrate, is heated rather than combusted, are known in the art. Typically, in such heated smoking articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article.

Substrates for heated aerosol-generating articles have, in the past, often been produced using randomly oriented shreds, strands, or strips of tobacco material. As an alternative, rods for heated aerosol-generating articles formed from gathered sheets of tobacco material have been disclosed, by way of example, in international patent application WO 2012/164009.

International patent application WO 2011/101164 discloses alternative rods for heated aerosol-generating articles formed from strands of homogenized tobacco material, which may be formed by casting, rolling, calendering or extruding a mixture comprising particulate tobacco and at least one aerosol former to form a sheet of homogenized tobacco material. In alternative embodiments, the rods of WO 2011/101164 may be formed from strands of homogenized tobacco material obtained by extruding a mixture comprising particulate tobacco and at least one aerosol former to form continuous lengths of homogenized tobacco material.

Alternative forms of substrates comprising nicotine have also been disclosed. By way of example, liquid nicotine compositions, often referred to as e-liquids, have been proposed. These liquid compositions may, for example, be heated by a coiled electrically resistive filament of an aerosol-generating device.

Substrates of this type may require particular care in the manufacture of the containers holding the liquid composition in order to prevent undesirable leakages. To address this issue and simplify the overall manufacturing process, it has also been proposed to provide a gel composition comprising nicotine that generates a nicotine-containing aerosol upon heating. By way of example, WO 2018/019543 discloses a thermoreversible gel composition, that is, a gel that will become fluid when heated to a melting temperature and will set into a gel again at a gelation temperature. The gel is provided within a housing of a cartridge, and the cartridge can be disposed of and replaced when the gel has been consumed.

In order for the gel composition to generate a satisfactory amount of aerosol during use, it is desirable for the gel composition to include a significant amount of an aerosol-former, such as glycerol. However, due to the plasticizing qualities of glycerol, it may be difficult to provide a gel composition that provides a good aerosol delivery during use and that is, at the same time, geometrically stable, that is, a gel composition that does not shrink significantly as it solidifies and settles into film form.

Thus, it would be desirable to provide an alternative aerosol-generating film that has an improved geometrical stability. It would also be desirable to provide an alternative aerosol-generating film that is easy to prepare and provide in a variety of forms, such as supported and unsupported. Additionally, it would be desirable to provide one such aerosol-generating film that has a high aerosol-former content, such that it can successfully be used as an aerosol-generating substrate in an aerosol-generating article, and that is easier to dispose of after use or that has reduced environmental impact. It would also be desirable to provide an alternative aerosol-generating film such that enables an easier adjustment of the aerosol delivery.

Thus, the present invention relates to an aerosol-generating film. The aerosol-generating film may comprise a cellulose based film-forming agent. The aerosol-generating film may further comprise a non-cellulose based thickening agent. The aerosol-generating film may also comprise water. The aerosol-generating film may comprise a polyhydric alcohol. The content of water may be less than or equal to about 30 wt percent. The content of polyhydric alcohol may be at least about 25 wt percent.

According to an aspect of the present invention, there is provided an aerosol-generating film comprising: a cellulose based film-forming agent; a non-cellulose based thickening agent; water; and a polyhydric alcohol. The content of water is less than or equal to about 30 wt percent and the content of polyhydric alcohol is at least about 25 wt percent.

According to another aspect of the present invention, there is provided the use of a film as set out above in an article for generating an inhalable aerosol upon heating.

According to a further aspect of the present invention, there is provided an aerosol-generating article for generating an inhalable aerosol upon heating, the article comprising an aerosol-generating substrate comprising a film as set out above.

In this connection, the present invention also relates to a system comprising an aerosol-generating device comprising one such aerosol-generating article and an aerosol-generating device comprising the power supply and the control circuitry. By way of example, the aerosol-generating device may be an electrically heated aerosol-generating device having an internal heater element for heating the aerosol-generating substrate comprising the film.

The aerosol-generating system may advantageously comprise: a consumable aerosol-generating article comprising the aerosol-generating film; and a reusable aerosol-generating device comprising the power supply and the control circuitry. The aerosol-generating system may comprise: an aerosol-generating article comprising the aerosol-generating film; and an aerosol-generating device comprising the heater assembly, the power supply and the control circuitry. The aerosol-generating system may comprise: an aerosol-generating article comprising the aerosol-generating film and the heater assembly; and an aerosol-generating device comprising the power supply and the control circuitry.

It will be appreciated that any features described with reference to one aspect of the present invention are equally applicable to any other aspect of the invention.

As used herein, the term "film" is used to describe a solid laminar element having a thickness that is less than the width or length thereof.

The film may be self-supporting. In other words, a film may have cohesion and mechanical properties such that the film, even if obtained by casting a film-forming formulation on a support surface, can be separated from the support surface.

Alternatively, the film may be disposed on a support or sandwiched between other materials. This may enhance the mechanical stability of the film.

In the context of the present invention the term "cellulose based film-forming agent" is used to describe a cellulosic polymer capable, by itself or in the presence of an auxiliary thickening agent, of forming a continuous film.

As used herein with reference to the invention, the term "non-cellulose based thickening agent" is used to describe a non-cellulosic substance that, when added to an aqueous or non-aqueous liquid composition, increases the viscosity of the liquid composition without substantially modifying its other properties. The thickening agent may increase stability, and improve suspension of components in the liquid composition. A thickening agent may also be referred to as a "thickener" or a "rheology modifier".

The term "aerosol generating article" is used herein to denote an article wherein an aerosol generating substrate is heated to produce and deliver an aerosol to a consumer. As used herein, the term "aerosol generating substrate" denotes a substrate capable of releasing volatile compounds upon heating to generate an aerosol.

A conventional cigarette is lit when a user applies a flame to one end of the cigarette and draws air through the other end. The localized heat provided by the flame and the oxygen in the air drawn through the cigarette causes the end of the cigarette to ignite, and the resulting combustion generates an inhalable smoke. By contrast, in heated aerosol generating articles, an aerosol is generated by heating a flavour generating substrate, such as a tobacco-based substrate or a substrate containing an aerosol-former and a flavouring.

Known heated aerosol generating articles include, for example, electrically heated aerosol generating articles and aerosol generating articles in which an aerosol is generated by the transfer of heat from a combustible fuel element or heat source to a physically separate aerosol forming material. For example, aerosol generating articles according to the invention may find particular application in aerosol generating systems comprising an electrically heated aerosol generating device having an internal heater blade which is adapted to supply heat to a film.

As used herein, the term "aerosol generating device" refers to a device comprising a heater element that interacts with an aerosol-generating film in accordance with the invention to produce an aerosol. During use, volatile compounds are released from the aerosol-generating film by heat transfer and entrained in air drawn through the aerosol generating article. As the released compounds cool they condense to form an aerosol that is inhaled by the consumer.

Substrates for heated aerosol-generating articles typically comprise an "aerosol former", that is, a compound or mixture of compounds that, in use, facilitates formation of the aerosol, and that preferably is substantially resistant to thermal degradation at the operating temperature of the aerosol-generating article. Examples of suitable aerosol-formers include: polyhydric alcohols, such as propylene glycol, triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

The polyhydric alcohol in the aerosol-generating film of the invention is also an aerosol former within the meaning set out above.

The term "exposed surface area of the film" is used herein to denote the cumulative surface area of the various surfaces of an aerosol-generating film in accordance with the invention that, during use, may become exposed to the gaseous airflow through the aerosol-generating article containing the film.

The term "thickness of a film" is used in the present specification to denote the minimum distance measured between opposite, substantially parallel surfaces of a film.

The thickness of the aerosol-generating film may substantially correspond to the thickness to which a corresponding film-forming composition is cast or extruded, as the cast or extruded film-forming composition substantially does not contract during drying, despite the loss of water.

The "weight of a film" in accordance with the invention will generally correspond to the weight of the components of the corresponding film-forming composition minus the weight of water evaporated during the drying step. If a film is self-supporting, the film can be weighed on its own. If a film is disposed on a support, the film and the support may be weighed and the weight of the support, measured prior to deposition of the film, is subtracted from the combined weight of the film and the support.

Unless stated otherwise, percentages by weight (which are identified herein by the expression "wt percent") of components of the aerosol-generating film recited herein are based on the total weight of the aerosol-generating film.

In contrast to existing aerosol-generating films as well as known orally dissolvable, nicotine-containing films, in the films of the invention a cellulose based film-forming agent (preferably HPMC) is combined with a non-cellulose based thickening agent and a polyhydric alcohol (preferably glycerin). It has been observed that significant amounts of a polyhydric alcohol such as glycerin—which is often included in film-forming compositions as a plasticiser—may adversely impact the geometric stability of the composition when it is cast on a support surface and dried to form the film. The inventors have surprisingly found that use of a cellulose based film-forming agent in combination with a non-cellulose based thickening agent may counter such effect, such that it is easier to form films with predetermined geometric parameters (for example, thickness, surface area, etc.) with high precision and repeatability.

In particular, as will be explained in more detail below, the inventors have surprisingly found that aerosol-generating films that comprise 6 wt percent or more of a cellulose based film-forming agent, and preferably HPMC, are especially stable. Thus, they substantially maintain their shape and mass when exposed to a variety of environmental conditions, such as a change in relative humidity from 10 percent to 60 percent. Accordingly, aerosol-generating films as described above advantageously do not release a liquid phase during storage or transportation.

Further, when heated in an aerosol-generating device, aerosol-generating films in accordance with the present invention may release an aerosol containing the polyhydric alcohol and, where present, an alkaloid compound, such as nicotine, without substantially releasing a liquid phase.

Thus, the invention advantageously provides a film having a significant polyhydric alcohol content that can easily be cast or extruded and solidified starting from a composition having a gel-like texture. As significant percentages of the polyhydric alcohol, particularly glycerin, can be provided in film form, whilst at the same time being able to finely control the geometry of the film, the invention advantageously provides a film that may find use as an aerosol-generating substrate in an aerosol-generating article designed to be heated to release the aerosol.

Upon heating, most of the components of the film essentially evaporate. In effect, it has been observed that only some residue of the cellulose based film-forming agent is typically left following use. As such, aerosol-generating articles incorporating substrates comprising a film in accordance with the invention may be easier to dispose of, and may have an improved environmental impact.

In addition, the inventors have surprisingly found that films in accordance with the invention may display tensile strength values that make them suitable for use as self-supporting substrates in an aerosol-generating article. This makes them versatile and advantageously adapted to be provided in a variety of shapes and arrangements within an aerosol-generating article.

By adjusting parameters such as thickness, exposed surface area of the film, or content of species such as nicotine or other alkaloid or compounds, or plant material or plant extracts or flavourants within the film, it is possible to finely control the delivery of said species in aerosol form to a consumer.

Further, films in accordance with the invention can be manufactured in a continuous process which can be efficiently carried out at high speed, and can be conveniently incorporated into existing production lines for the manufacture of heated aerosol-generating articles.

As described briefly above, an aerosol-generating film in accordance with the invention comprises a cellulose based film-forming agent; a non-cellulose based thickening agent; water, which accounts for less than or equal to about 30 wt percent of the film; and a polyhydric alcohol, which accounts for at least about 25 wt percent of the film.

One such film can be formed from a film-forming composition containing the above components in predetermined, weighed amounts. By way of example, in a method of manufacturing a film in accordance with the invention, a film-forming composition may be provided that comprises the cellulose based film-forming agent; the non-cellulose based thickening agent; at least about 30 wt percent of water; and at least about 10 wt percent of the polyhydric alcohol.

In a first step the cellulose based film-forming agent and the thickening agent are dissolved into water. Preferably, heat is supplied to the aqueous mixture or the aqueous mixture is agitated or both, with a view to facilitating the achievement of full dissolution. In a second step, the polyhydric alcohol is added, optionally along with other components as will be described in more detail below. In a third step, the film-forming composition thus obtained is applied on a support surface, such as for example by casting or extrusion, and left to solidify, preferably at room temperature. In a fourth step, water is evaporated by supplying heat to the applied film-forming composition. This effectively amounts to a drying step, and may preferably be carried out by heating the applied film-forming composition at a temperature of at least about 50 degrees Celsius. During the drying step, the water content of the applied film-forming composition is lowered to obtain the aerosol-generating film until the film contains 30 wt percent or less of water. The film may then be detached from the support surface.

Preferably, in an aerosol-generating film in accordance with the invention the cellulose based film-forming agent is selected from the group consisting of hydroxypropyl methylcellulose (HPMC), methylcellulose (MC), ethylcellulose (EC), hydroxyethyl methyl cellulose (HEMC), hydroxyethyl cellulose (HEC), hydroxypropyl cellulose (HPC), and combinations thereof.

More preferably, in an aerosol-generating film in accordance with the invention, the cellulose based film-forming agent is selected from the group consisting of hydroxypropyl methylcellulose (HPMC), methylcellulose (MC), ethylcellulose (EC), and combinations thereof.

In particularly preferred embodiment, the cellulose based film-forming agent is HPMC.

An aerosol-generating film in accordance with the present invention may comprise at least about 3 wt percent of a cellulose based film-forming agent. An aerosol-generating film in accordance with the present invention may comprise up to about 70 wt percent of a cellulose based film-forming agent. An aerosol-generating film in accordance with the present invention may comprise from about 3 wt percent to about 70 wt percent of a cellulose based film-forming agent.

In preferred embodiments, an aerosol-generating film in accordance with the present invention comprises at least about 5 wt percent of a cellulose based film-forming agent.

More preferably, an aerosol-generating film in accordance with the present invention comprises at least about 6 wt percent of a cellulose based film-forming agent. Even more preferably, an aerosol-generating film in accordance with the present invention comprises at least about 10 wt percent of a cellulose based film-forming agent.

Preferably, the aerosol-generating film comprises at least about 14 wt percent weight of a cellulose based film-forming agent. More preferably, the aerosol-generating film comprises at least about 16 wt percent weight of a cellulose based film-forming agent. Even more preferably, the aerosol-generating film comprises at least about 18 wt percent weight of a cellulose based film-forming agent.

In addition, or as an alternative, the aerosol-generating film preferably comprises less than or equal to about 26 wt percent weight of a cellulose based film-forming agent. More preferably, the aerosol-generating film comprises less than or equal to about 24 wt percent weight of a cellulose based film-forming agent. Even more preferably, the aerosol-generating film comprises less than or equal to about 22 wt percent weight of a cellulose based film-forming agent.

In particularly preferred embodiments, an aerosol-generating film comprises at least about 3 wt percent of HPMC. An aerosol-generating film in accordance with the present invention may comprise up to about 70 wt percent of HPMC. An aerosol-generating film in accordance with the present invention may comprise from about 3 wt percent to about 70 wt percent of HPMC.

More preferably, an aerosol-generating film in accordance with the present invention comprises at least about 5 wt percent of HPMC, even more preferably at least about 6 wt percent of HPMC, most preferably at least 10 wt percent of HPMC.

In preferred embodiments, the aerosol-generating film comprises at least about 14 wt percent weight of HPMC. More preferably, the aerosol-generating film comprises at least about 16 wt percent weight of HPMC. Even more preferably, the aerosol-generating film comprises at least about 18 wt percent weight of HPMC. In addition, or as an alternative, the aerosol-generating film preferably comprises less than or equal to about 26 wt percent weight of HPMC. More preferably, the aerosol-generating film comprises less than or equal to about 24 wt percent weight of HPMC. Even more preferably, the aerosol-generating film comprises less than or equal to about 22 wt percent weight of HPMC.

In some preferred embodiments, the aerosol-generating film comprises from about 14 wt percent weight to about 26 wt percent of HPMC. More preferably, the aerosol-generating film comprises from about 16 wt percent weight to about 24 wt percent of HPMC. Even more preferably, the aerosol-generating film comprises from about 18 wt percent weight to about 22 wt percent of HPMC.

In an aerosol-generating film in accordance with the invention the non-cellulose based thickening agent may be selected from the group consisting of agar, xanthan gum, alginate, gellan gum, carrageenan, guar gum, gum Arabic, locust bean gum, pectins, starches, and combinations thereof.

Preferably, in an aerosol-generating film in accordance with the invention the non-cellulose based thickening agent is selected from the group consisting of agar, xanthan gum, alginate, and combinations thereof. In preferred embodiments, the non-cellulose based thickening agent is agar.

An aerosol-generating film in accordance with the present invention may comprise up to about 50 wt percent of a non-cellulose based thickening agent. In preferred embodiments, an aerosol-generating film in accordance with the present invention may comprise up to about 50 wt percent of agar.

Preferably, the aerosol-generating film comprises at least about 1 wt percent weight of a non-cellulose based thickening agent. More preferably, the aerosol-generating film comprises at least about 2 wt percent weight of a non-cellulose based thickening agent. Even more preferably, the aerosol-generating film comprises at least about 3 wt percent weight of a non-cellulose based thickening agent. In addition, or as an alternative, the aerosol-generating film preferably comprises less than or equal to about 10 wt percent weight of a non-cellulose based thickening agent. More preferably, the aerosol-generating film comprises less than or equal to about 8 wt percent weight of a non-cellulose based thickening agent. Even more preferably, the aerosol-generating film comprises less than or equal to about 6 wt percent weight of a non-cellulose based thickening agent.

In some preferred embodiments, the aerosol-generating film comprises from about 1 wt percent to about 10 wt percent of a non-cellulose based thickening agent. More preferably, the aerosol-generating film comprises from about 2 wt percent to about 8 wt percent of a non-cellulose based thickening agent. Even more preferably, the aerosol-generating film comprises from about 3 wt percent to about 6 wt percent of a non-cellulose based thickening agent.

In preferred embodiments, the aerosol-generating film comprises at least about 1 wt percent weight of agar. More preferably, the aerosol-generating film comprises at least about 2 wt percent weight of agar. Even more preferably, the aerosol-generating film comprises at least about 3 wt percent weight of agar. In addition, or as an alternative, the aerosol-generating film preferably comprises less than or equal to about 10 wt percent weight of agar. More preferably, the aerosol-generating film comprises less than or equal to about 8 wt percent weight of agar. Even more preferably, the aerosol-generating film comprises less than or equal to about 6 wt percent weight of agar.

In some preferred embodiments, the aerosol-generating film comprises from about 1 wt percent to about 10 wt percent of agar. More preferably, the aerosol-generating film comprises from about 2 wt percent to about 8 wt percent of agar. Even more preferably, the aerosol-generating film comprises from about 3 wt percent to about 6 wt percent of agar.

Polyhydric alcohols suitable as aerosol-formers include, but are not limited to, propylene glycol, triethylene glycol, 1,3-butanediol, and glycerin. Preferably, in an aerosol-generating film in accordance with the invention the polyhydric alcohol is selected from the group consisting of glycerin, propylene glycol, and combinations thereof. In particularly preferred embodiments the polyhydric alcohol is glycerin.

As set out briefly above, an aerosol-generating film in accordance with the invention contains at least about 25 wt percent of a polyhydric alcohol. More preferably, the aerosol-generating film comprises at least about 30 wt percent of a polyhydric alcohol, even more preferably at least about 35 wt percent of a polyhydric alcohol.

In particularly preferred embodiments, the aerosol-generating film comprises at least about 40 wt percent of a polyhydric alcohol, even more preferably at least about 42 wt percent of a polyhydric alcohol. Most preferably, the aerosol-generating film comprises at least about 44 wt percent of a polyhydric alcohol.

In addition, or as an alternative, the aerosol-generating film preferably comprises less than about 90 wt percent of a polyhydric alcohol. More preferably, the aerosol-generating film preferably comprises less than about 85 wt percent of a polyhydric alcohol. Even more preferably, the aerosol-generating film preferably comprises less than about 80 wt percent of a polyhydric alcohol. In some preferred embodiments, the aerosol-generating film preferably comprises less than about 75 wt percent of a polyhydric alcohol, more preferably less than 70 wt percent of a polyhydric alcohol, even more preferably less than 65 wt percent of a polyhydric alcohol. In some particularly preferred embodiments, the aerosol-generating film comprises less than 60 wt percent of a polyhydric alcohol.

In preferred embodiments, an aerosol-generating film in accordance with the invention contains at least about 25 wt percent of glycerin. More preferably, the aerosol-generating film comprises at least about 30 wt percent of glycerin, even more preferably at least about 35 wt percent of glycerin.

In particularly preferred embodiments, the aerosol-generating film comprises at least about 40 wt percent of glycerin, even more preferably at least about 42 wt percent of glycerin. Most preferably, the aerosol-generating film comprises at least about 44 wt percent of glycerin.

In addition, or as an alternative, the aerosol-generating film preferably comprises less than about 90 wt percent of glycerin. More preferably, the aerosol-generating film preferably comprises less than about 85 wt percent of glycerin. Even more preferably, the aerosol-generating film preferably comprises less than about 80 wt percent of glycerin. In some preferred embodiments, the aerosol-generating film preferably comprises less than about 75 wt percent of glycerin, more preferably less than 70 wt percent of glycerin, even more preferably less than 65 wt percent of the glycerin. In some particularly preferred embodiments, the aerosol-generating film comprises less than 60 wt percent of glycerin.

Preferably, in the aerosol-generating film a ratio between the weight of cellulose based film-forming agent and the weight of polyhydric alcohol is at least about 0.1, more preferably at least about 0.2, even more preferably about 0.3. In addition, or as an alternative, in the aerosol-generating film a ratio between the weight of cellulose based film-forming agent and the weight of polyhydric alcohol is preferably less than or equal to about 1.

In preferred embodiments, in the aerosol-generating film a ratio between the weight of cellulose based film-forming agent and the weight of polyhydric alcohol is from about 0.1 to about 1.

In preferred embodiments, in the aerosol-generating film a ratio between the weight of HPMC and the weight of glycerin is at least about 0.1, more preferably at least about 0.2, even more preferably about 0.3. In addition, or as an alternative, in the aerosol-generating film a ratio between the weight of HPMC and the weight of glycerin is preferably less than or equal to about 1.

In preferred embodiments, in the aerosol-generating film a ratio between the weight of HPMC and the weight of glycerin is from about 0.1 to about 1.

In some particularly preferred embodiments, the aerosol-generating film comprises from about 1 gram of HPMC to about 10 grams of HPMC per 10 grams of glycerin.

Preferably, in the aerosol-generating film a ratio between the weight of non-cellulose based thickening agent and the weight of polyhydric alcohol is at least about 0.05, more preferably at least 0.1, even more preferably at least 0.2. In addition, or as an alternative, in the aerosol-generating film a ratio between the weight of non-cellulose based thickening agent and the weight of polyhydric alcohol is preferably less than or equal to about to 0.5.

In preferred embodiments, in the aerosol-generating film a ratio between the weight of non-cellulose based thickening agent and the weight of polyhydric alcohol is from about 0.1 to about 0.5.

Preferably, in the aerosol-generating film a ratio between the weight of agar and the weight of glycerin is at least about 0.05, more preferably at least 0.1, even more preferably at least 0.2. In addition, or as an alternative, in the aerosol-generating film a ratio between the weight of agar and the weight of glycerin is preferably less than or equal to about to 0.5.

In preferred embodiments, in the aerosol-generating film a ratio between the weight of agar and the weight of glycerin is from about 0.1 to about 0.5.

In some particularly preferred embodiments, the aerosol-generating film comprises from 0.5 grams of agar to about 5 grams of agar per 10 grams of glycerin.

In some embodiments, the aerosol-generating film comprises an alkaloid compound or a cannabinoid compound or both.

As used herein with reference to the invention, the term "alkaloid compound" is used to describe any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In the context of the present invention, the term "alkaloid compounds" is used to describe both naturally derived alkaloid compounds and synthetically manufactured alkaloid compounds.

Suitable alkaloid compounds for use in an aerosol-generating film in accordance with the invention include nicotine and anatabine.

As used herein with reference to the invention, the term "cannabinoid compound" is used to describe any one of a class of naturally occurring compounds that are found in parts of the *cannabis* plant—namely the species *Cannabis sativa, Cannabis indica*, and *Cannabis ruderalis*. Cannabinoid compounds are especially concentrated in the female flower heads. Cannabinoid compounds naturally occurring the in *cannabis* plant include tetrahydrocannabinol (THC) and cannabidiol (CBD). In the context of the present invention, the term "cannabinoid compounds" is used to describe both naturally derived cannabinoid compounds and synthetically manufactured cannabinoid compounds.

Cannabinoid compounds suitable for use in an aerosol-generating film in accordance with the invention include tetrahydrocannabinol (THC), tetrahydrocannabinolic acid (THCA), cannabidiol (CBD), cannabidiolic acid (CBDA), cannabinol (CBN), cannabigerol (CBG), cannabigerol monomethyl ether (CBGM), cannabivarin (CBV), cannabidivarin (CBDV), tetrahydrocannabivarin (THCV), cannabichromene (CBC), cannabicyclol (CBL), cannabichromevarin (CBCV), cannabigerovarin (CBGV), cannabielsoin (CBE), cannabicitran (CBT).

In general, the aerosol-generating film may comprise up to about 10 wt percent of an alkaloid compound or a cannabinoid compound or both. In view of applications of the aerosol-generating film of the invention as a substrate in an aerosol-generating article, this is advantageous as the content of alkaloid compound or cannabinoid compound or both in the film may be increased and adjusted with a view to optimizing the delivery of alkaloid compound or cannabinoid compound or both in aerosol form to the consumer. Compared with existing aerosol-generating substrates based on the use of plant material, this may advantageously allow for higher contents of alkaloid compound or cannabinoid compound or both per volume of substrate (film) or per weight of substrate (film), which may be desirable from a manufacturing viewpoint.

Preferably, the aerosol-generating film comprises at least about 0.5 wt percent of an alkaloid compound or a cannabinoid compound or both. Thus, the aerosol-generating film preferably comprises at least about 0.5 wt percent of an alkaloid compound or at least 0.5 wt percent of a cannabinoid compound or at least about 0.5 wt percent of a combination of an alkaloid compound and a cannabinoid compound.

More preferably, the aerosol-generating film comprises at least about 1 wt percent of an alkaloid compound or a cannabinoid compound or both. Even more preferably, the aerosol-generating film comprises at least about 2 wt percent of an alkaloid compound or a cannabinoid compound or both. In addition, or as an alternative, the aerosol-generating film preferably comprises less than about 6 wt percent of an alkaloid compound or a cannabinoid compound or both. More preferably, the aerosol-generating film comprises less than about 5 wt percent of an alkaloid compound or a cannabinoid compound or both. Even more preferably, the aerosol-generating film comprises less than about 4 wt percent of an alkaloid compound or a cannabinoid compound or both.

In preferred embodiments, the aerosol-generating film comprises from about 0.5 wt percent to about 10 wt percent of an alkaloid compound or a cannabinoid compound or both, more preferably from about 1 wt percent to about 6 wt percent of an alkaloid compound or a cannabinoid compound or both, even more preferably from about 2 wt percent to about 5 wt percent of an alkaloid compound or a cannabinoid compound or both.

In some embodiments, the aerosol-generating film comprises one or more of a cannabinoid and an alkaloid compound comprising nicotine or anatabine. In some preferred embodiments, the aerosol-generating film comprises nicotine.

As used herein with reference to the invention, the term "nicotine" is used to describe nicotine, a nicotine base or a nicotine salt. In embodiments in which the aerosol-generating film comprises a nicotine base or a nicotine salt, the amounts of nicotine recited herein are the amount of free base nicotine or amount of protonated nicotine, respectively.

The aerosol-generating film may comprise natural nicotine or synthetic nicotine.

The aerosol-generating film may comprise one or more monoprotic nicotine salts.

As used herein with reference to the invention, the term "monoprotic nicotine salt" is used to describe a nicotine salt of a monoprotic acid.

In general, the aerosol-generating film may comprise up to about 10 wt percent nicotine. In view of applications of the aerosol-generating film of the invention as a substrate in an aerosol-generating article, this is advantageous as the content of nicotine in the film may be increased and adjusted with a view to optimizing the delivery of nicotine in aerosol form to the consumer. Compared with existing aerosol-generating substrates based on the use of tobacco plant, this may advantageously allow for higher contents of nicotine per volume of substrate (film) or per weight of substrate (film), which may be desirable from a manufacturing viewpoint.

Preferably, the aerosol-generating film comprises at least about 0.5 wt percent nicotine. More preferably, the aerosol-generating film comprises at least about 1 wt percent nicotine. Even more preferably, the aerosol-generating film comprises at least about 2 wt percent nicotine. In addition, or as an alternative, the aerosol-generating film preferably comprises less than about 6 wt percent nicotine. More preferably, the aerosol-generating film comprises less than about 5 wt percent nicotine. Even more preferably, the aerosol-generating film comprises less than about 4 wt percent nicotine.

In preferred embodiments, the aerosol-generating film comprises from about 0.5 wt percent to about 10 wt percent nicotine, more preferably from about 1 wt percent to about 6 wt percent nicotine, even more preferably from about 2 wt percent to about 5 wt percent nicotine.

In some preferred embodiments, the aerosol-generating film comprises a cannabinoid compound. Preferably, the cannabinoid compound is selected from CBD and THC. More preferably, the cannabinoid compound is CBD.

The aerosol-generating film may comprise up to about 10 wt percent of CBD. Preferably, the aerosol-generating film comprises at least about 0.5 wt percent CBD. More preferably, the aerosol-generating film comprises at least about 1 wt percent CBD. Even more preferably, the aerosol-generating film comprises at least about 2 wt percent CBD. In addition, or as an alternative, the aerosol-generating film preferably comprises less than about 6 wt percent CBD. More preferably, the aerosol-generating film comprises less than about 5 wt percent CBD. Even more preferably, the aerosol-generating film comprises less than about 4 wt percent CBD.

In preferred embodiments, the aerosol-generating film comprises from about 0.5 wt percent to about 10 wt percent CBD, more preferably from about 1 wt percent to about 6 wt percent CBD, even more preferably from about 2 wt percent to about 5 wt percent CBD.

The aerosol-generating film may be a substantially tobacco-free aerosol-generating film.

As used herein with reference to the invention, the term "substantially tobacco-free aerosol-generating film" describes an aerosol-generating film having a tobacco content of less than 1 percent by weight. For example, the aerosol-generating film may have a tobacco content of less than about 0.75 percent by weight, less than about 0.5 percent by weight or less than about 0.25 percent by weight.

The aerosol-generating film may be a tobacco-free aerosol-generating film.

As used herein with reference to the invention, the term "tobacco-free aerosol-generating film" describes an aerosol-generating film having a tobacco content of 0 percent by weight.

In some embodiments, the aerosol-generating film comprises tobacco material or a non-tobacco plant material or a plant extract. By way of example, the aerosol-generating film may comprise tobacco particles, such as tobacco lamina particles, as well as particles of other botanicals, such as clove and eucalyptus.

In preferred embodiments, the aerosol-generating film comprises an acid. More preferably, the aerosol-generating film comprises one or more organic acids. Even more preferably, the aerosol-generating film comprises one or more carboxylic acids. In particularly preferred embodiments, the acid is lactic acid or levulinic acid.

The inclusion of an acid is especially preferred in embodiments of the aerosol-generating film comprising nicotine, as it has been observed that the presence of an acid may stabilize dissolved species in the film-forming composition, such as with nicotine and other plant extracts. Without wishing to be bound by theory, it is understood that the acid may interact with the nicotine molecule, especially where nicotine is provided in salt form, and this substantially prevents nicotine from evaporating during the drying operation. As such, the loss of nicotine during manufacturing of the film can be minimized, and higher, better controlled nicotine delivery to the consumer can advantageously be ensured.

Preferably, the aerosol-generating film comprises at least about 0.25 wt percent of an acid. More preferably, the aerosol-generating film comprises at least about 0.5 wt percent of an acid. Even more preferably, the aerosol-generating film comprises at least about 1 wt percent of an acid. In addition, or as an alternative, the aerosol-generating film preferably comprises less than about 3.5 wt percent of an acid. More preferably, the aerosol-generating film comprises less than about 3 wt percent of an acid. Even more preferably, the aerosol-generating film comprises less than about 2.5 wt percent of an acid.

In preferred embodiments, the aerosol-generating film comprises from about 0.25 wt percent to about 3.5 wt percent of an acid. More preferably, the aerosol-generating film comprises from about 0.5 wt percent to about 3 wt percent of an acid. Even more preferably, the aerosol-generating film comprises from about 1 wt percent to about 2.5 wt percent of an acid.

In preferred embodiments, the aerosol-generating film comprises at least about 0.25 wt percent of levulinic acid. More preferably, the aerosol-generating film comprises at least about 0.5 wt percent of levulinic acid. Even more preferably, the aerosol-generating film comprises at least about 1 wt percent of levulinic acid. In addition, or as an alternative, the aerosol-generating film preferably comprises less than about 3.5 wt percent of levulinic acid. More preferably, the aerosol-generating film comprises less than about 3 wt percent of levulinic acid. Even more preferably, the aerosol-generating film comprises less than about 2.5 wt percent of levulinic acid.

In preferred embodiments, the aerosol-generating film comprises from about 0.25 wt percent to about 3.5 wt percent of levulinic acid. More preferably, the aerosol-generating film comprises from about 0.5 wt percent to about 3 wt percent of levulinic acid. Even more preferably, the aerosol-generating film comprises from about 1 wt percent to about 2.5 wt percent of levulinic acid.

In preferred embodiments, the aerosol-generating film comprises at least about 0.25 wt percent of lactic acid. More preferably, the aerosol-generating film comprises at least about 0.5 wt percent of lactic acid. Even more preferably, the aerosol-generating film comprises at least about 1 wt percent of lactic acid. In addition, or as an alternative, the aerosol-generating film preferably comprises less than about 3.5 wt percent of lactic acid. More preferably, the aerosol-generating film comprises less than about 3 wt percent of lactic acid. Even more preferably, the aerosol-generating film comprises less than about 2.5 wt percent of lactic acid.

In preferred embodiments, the aerosol-generating film comprises from about 0.25 wt percent to about 3.5 wt percent of lactic acid. More preferably, the aerosol-generating film comprises from about 0.5 wt percent to about 3 wt percent of lactic acid. Even more preferably, the aerosol-generating film comprises from about 1 wt percent to about 2.5 wt percent of lactic acid.

The aerosol-generating film may optionally comprise a flavourant. In some embodiments, the aerosol-generating film may comprise up to about 2 wt percent of a flavourant. By way of example, the aerosol-generating film may comprise menthol. Other suitable flavourants may include one or more of terpenes, terpenoids, eugenol, eucalyptol.

In particularly preferred embodiments, the aerosol-generating film consists of: from about 14 wt percent to about 26 wt percent HPMC; from about 3 wt percent to about 6 wt percent agar; from about 0.5 wt percent to about 4 wt percent nicotine; from about 0.25 wt percent to about 3 wt percent of an acid; from about 44 wt percent to about 60 wt percent glycerin; from 0 wt percent to about 2 wt percent of a flavourant; and balance water.

Aerosol-generating films having the compositions described above have been found to be particularly easy to form with good repeatability, and have been found to provide satisfactory nicotine delivery to the consumer when heated to generate an aerosol. Further, it has been found that the tendency of the nicotine to evaporate during manufacturing (particularly during the drying step that leads to the formation of the film itself from the corresponding gel-like, film-forming composition) has been substantially countered by the inclusion of the acid.

Preferably, an aerosol-generating film in accordance with the invention has a thickness of less than about 1 millimetre. More preferably, the aerosol-generating film has a thickness of less than about 0.75 millimetres. Even more preferably, the aerosol-generating film has a thickness of less than about 0.5 millimetres.

In particularly preferred embodiments, a layer of the film-forming composition is formed that has a thickness of less than or equal to about 400 micrometres, more preferably less than or equal to about 300 micrometres, even more preferably less than or equal to about 200 micrometres.

In addition, or as an alternative, the aerosol-generating film has a thickness of at least about 0.1 millimetres.

In preferred embodiments, the aerosol-generating film has a thickness from about 0.1 millimetres to about 1 millimetre, more preferably from about 0.1 millimetres to about 0.75 millimetres, even more preferably from about 0.1 millimetres to about 0.5 millimetres. In particularly preferred embodiments, a layer of the film-forming composition is formed that has a thickness from about 50 micrometres to 400 micrometres, more preferably from about 100 micrometres to 200 micrometres.

This is advantageous as the aerosol-generating film obtained under such circumstances has a thickness comparable to the thickness of cast leaf or reconstituted tobacco or other homogenized tobacco materials used for forming a substrate in an aerosol-generating article. Further, aerosol-generating films having a thickness falling within the ranges described above have been found to have sufficient strength whilst at the same time having a low weight, which helps decrease thermal inertia of the aerosol-generating substrate during use of an aerosol-generating article comprising the film as a substrate.

The thickness of the aerosol-generating film may effectively be controlled by controlling the thickness of the layer of film-forming composition applied on a planar surface during manufacturing. This may, for example, be done by casting. Casting may be a simple way of processing the film-forming composition for obtaining the film. While it is typically a batch procedure used on a small scale, a continuous casting method (for example, based on knife-coating or tape-casting) may be used at the industrial scale, since the film-forming composition may be prepared on continuous carrier tapes such as to enable an effective control of the thickness of the layer. As an alternative, the film-forming composition may be formed into a layer having a predetermined thickness by extrusion.

Films in accordance with the invention preferably have a basis weight of at least about 100 grams per square metre. More preferably, films in accordance with the invention have a basis weight of at least about 120 grams per square metre. Even more preferably, films in accordance with the invention have a basis weight of at least about 140 grams per square metre.

Films in accordance with the invention preferably have a basis weight less than or equal to 300 grams per square metre. More preferably, films in accordance with the invention have a basis weight less than or equal to 280 grams per square metre. Even more preferably, films in accordance with the invention have a basis weight less than or equal to 260 grams per square metre.

In preferred embodiments, films in accordance with the invention have a basis weight from about 100 grams per square metre to about 300 grams per square metre, more preferably from about 120 grams per square metre to about 280 grams per square metre, even more preferably from about 140 grams per square metre to about 260 grams per square metre. In particularly preferred embodiments, films in accordance with the invention have a basis weight of about 200 grams per square metre.

Films as described above may find use as aerosol-generating substrates for aerosol-generating articles of the type wherein the substrate is heated to release an inhalable aerosol—as opposed to articles wherein a substrate is burned to produce an inhalable smoke.

Because films in accordance with the invention are easy to manufacture and finely controlled amounts of a corresponding film-forming composition may be applied on a supporting surface to form the films, and because the composition of the films—especially as regards the content of the polyhydric alcohol and, where present, of the nicotine or plant material (including both tobacco and non-tobacco plant material)—can be finely tuned and controlled, aerosol-generating films in accordance with the invention are versatile and can be used as substrates in a number of forms. For example, films in accordance with the invention may be used as aerosol-generating substrates in supported form as well as self-supporting form. Further, films in accordance with the invention may be used in different shapes and sizes, such that an exposed surface area of the film can also be adjusted and tailored to specific uses and needs.

By way of example, an aerosol-generating film in accordance with the invention may be provided on the inner surface of a tubular carrier element, such that the outer surface of the aerosol-generating film is exposed inside the longitudinal internal channel defined by the tubular carrier element. Upon heating, an aerosol can be generated from the aerosol-generating film, which is thus released into the internal channel and can be drawn through the aerosol-generating article into the consumer's mouth.

As an alternative, an aerosol-generating film in accordance with the invention may be configured such that it forms a self-supporting rod and no additional support structures are required within the aerosol-generating substrate. By way of example, one or more aerosol-generating films in accordance with the invention may be gathered to form a rod of aerosol-generating substrate. Alternatively, a plurality of films in accordance with the invention may be stacked into a rod of aerosol-generating substrate. In a further alternative arrangement, a plurality of strips or shreds of an aerosol-generating film in accordance with the invention may be aligned, brought together and wrapped to form a rod of aerosol-generating substrate. Alternatively, the strips or shreds of aerosol-generating film may be randomly oriented within the rod.

The invention will now be further described with reference to the following

EXAMPLES

Table 1 below describes the composition of aerosol-generating films, along with the formulation of film-forming compositions from which the aerosol-generating films are obtained.

TABLE 1

| Example | Film-forming composition (w/w) | Aerosol-generating film composition (w/w) |
|---|---|---|
| 1 | 4.41% HPMC | 19.27% HPMC |
| | 1.10% Agar | 4.8% Agar |
| | 0.33% Nicotine | 1.44% Nicotine |
| | 11% Glycerin | 48% Glycerin |
| | 0.47% Levulinic acid | 2.07% Levulinic acid |
| | 82.69% Water | 24.42% Water |
| 2 | 6.03% HPMC | 20.38% HPMC |
| | 1.51% Agar | 5.09% Agar |
| | 0.5% Nicotine | 1.70% Nicotine |
| | 15.07% Glycerin | 50.94% Glycerin |
| | 0.56% Levulinic acid | 1.89% Levulinic acid |
| | 76.34% Water | 20% Water |
| 3 | 7.75% HPMC | 11.04% HPMC |
| | 2.33% Agar | 3.31% Agar |
| | 1.47% Nicotine | 2.10% Nicotine |
| | 46.51% Glycerin | 66.22% Glycerin |
| | 1.64% Levulinic acid | 2.33% Levulinic acid |
| | 40.30% Water | 15% Water |

Aerosol-generating films are manufactured based on the compositions in Table 1. To this purpose, the HPMC and agar are mixed in glycerin using agitation until dissolution. Water, nicotine and levulinic acid are then added under agitation until dissolution. A layer of the film-forming composition thus obtained is formed on a plane surface and left to solidify. The layer of film-forming composition is formed with a thickness of about 210 micrometres. The layer of film-forming composition thus formed is heated to about 140 degrees Celsius for about 8 minutes.

The aerosol-generating film obtained after drying is solid. In other words, the aerosol-generating film has a stable size and shape and does not flow. The term "stable" is used herein to indicate that the aerosol-generating films in accordance with the invention substantially maintains its shape and mass when exposed to a variety of environmental conditions. As such, it substantially does not release or absorb water when exposed to standard temperature and pressure while varying the relative humidity from about 10 percent to about 60 percent.

This is particularly advantageous as it ensures that films in accordance with the present invention do not release a liquid phase during storage or transportation, for example, from the manufacturing facility to a point of sale.

The aerosol-generating films prepared as described above are heated to a temperature from about 180 degrees Celsius to about 250 degrees Celsius to simulate the conditions of use in an aerosol-generating device. The nicotine, glycerin and water contained in the film evaporate. The nicotine and glycerin condense to form an inhalable aerosol. The aerosol-generating film shrinks slightly and its volume is reduced. However, the film remains solid and maintains its film form. It appears to harden slightly and to take on a darker, brownish colour.

The invention claimed is:

1. An aerosol-generating film having a tobacco content of less than 1 percent by weight, the aerosol-generating film comprising:

a cellulose based film-forming agent;

a non-cellulose based thickening agent;

water;

nicotine; and a polyhydric alcohol, wherein the cellulose based film-forming agent is selected from the group consisting of hydroxypropyl methylcellulose (HPMC), methylcellulose (MC), ethylcellulose (EC), hydroxyethyl methyl cellulose (HEMC), hydroxyethyl cellulose (HEC), hydroxypropyl cellulose (HPC), and combinations thereof, a content of cellulose based film-forming agent is at least about 14 wt percent weight and less than or equal to about 26 wt percent, and wherein a content of water is less than about 30 wt percent and a content of polyhydric alcohol is at least about 30 wt percent.

2. The aerosol-generating film according to claim 1, wherein the content of polyhydric alcohol is at least about 40 wt percent.

3. The aerosol-generating film according to claim 1, wherein the cellulose based film-forming agent is selected from the group consisting of hydroxypropyl methylcellulose (HPMC), methylcellulose (MC), ethyl cellulose (EC), and combinations thereof.

4. The aerosol-generating film according to claim 1, wherein a content of non-cellulose based thickening agent is from about 1 wt percent to about 10 wt percent.

5. The aerosol-generating film according to claim 1, wherein the non-cellulose based thickening agent is selected from the group consisting of agar, xanthan gum, alginate, and combinations thereof.

6. The aerosol-generating film according to claim 1, comprising at least 3 wt percent of the non-cellulose based thickening agent.

7. The aerosol-generating film according to claim 1, wherein the polyhydric alcohol is selected from the group consisting of glycerin, propylene glycol, and combinations thereof.

8. The aerosol-generating film according to claim 1, further comprising a cannabinoid compound.

9. The aerosol-generating film according to claim 1, further comprising a non-tobacco plant material or a plant extract.

10. The aerosol-generating film according to claim 1, further comprising an acid.

11. The aerosol-generating film according to claim 10, wherein the acid is lactic acid or levulinic acid.

12. The aerosol-generating film according to claim 1, further comprising a flavorant.

13. The aerosol-generating film according to claim 1, consisting of:

from about 14 wt percent to about 26 wt percent hydroxypropyl methylcellulose (HPMC), from about 3 wt percent to about 6 wt percent agar, from about 0.5 wt percent to about 4 wt percent nicotine, from about 0.25 wt percent to about 3 wt percent of an acid, from about 44 wt percent to about 60 wt percent glycerin, from 0 wt percent to about 2 wt percent of a flavorant, and balance water.

14. The aerosol-generating film according to claim 1, wherein the aerosol-generating film has a thickness of less than about 1 millimeter.

15. The aerosol-generating film according to claim 1, wherein the aerosol-generating film has a thickness of at least about 0.1 millimeter.

16. An aerosol-generating article for generating an inhalable aerosol upon heating, the aerosol-generating article comprising an aerosol-generating substrate comprising an aerosol-generating film according to claim 1.

* * * * *